US007736249B2

(12) United States Patent
Zhang

(10) Patent No.: US 7,736,249 B2
(45) Date of Patent: Jun. 15, 2010

(54) DIGITALLY CONTROLLED, USER PROGRAMMABLE AND FIELD RELOCATABLE TABLE TENNIS ROBOT

(76) Inventor: He Zhang, 3 Warwick Mill Ct., Cockeysville, MD (US) 21030

( * ) Notice: Subject to any disclaimer, the term of this patent is extended or adjusted under 35 U.S.C. 154(b) by 270 days.

(21) Appl. No.: 11/795,077

(22) PCT Filed: Mar. 21, 2005

(86) PCT No.: PCT/US2005/009236

§ 371 (c)(1),
(2), (4) Date: Jul. 12, 2007

(87) PCT Pub. No.: WO2006/101488

PCT Pub. Date: Sep. 28, 2006

(65) Prior Publication Data

US 2009/0011872 A1 Jan. 8, 2009

(51) Int. Cl.
*A63B 69/00* (2006.01)
*F41B 4/00* (2006.01)

(52) U.S. Cl. ..... 473/475; 473/459; 124/78

(58) Field of Classification Search ..... 473/431, 473/436, 422, 459, 460, 475; 124/6, 48, 124/78, 81

See application file for complete search history.

(56) References Cited

U.S. PATENT DOCUMENTS

| | | | | |
|---|---|---|---|---|
| 5,383,658 | A * | 1/1995 | Newgarden, Jr. | 473/475 |
| 5,485,995 | A * | 1/1996 | Newgarden, Jr. | 124/49 |
| 5,566,936 | A * | 10/1996 | Newgarden et al. | 473/475 |
| 5,607,151 | A * | 3/1997 | Daley | 124/78 |
| 6,371,872 | B1 | 4/2002 | Daley | |
| 2007/0238555 | A1 * | 10/2007 | Fang | 473/431 |
| 2009/0011872 | A1 * | 1/2009 | Zhang | 473/459 |

* cited by examiner

*Primary Examiner*—Raleigh W. Chiu

(57) ABSTRACT

A table tennis robot system characterized in that all the motion control mechanisms of the robot are digitally controlled and fully user programmable and the robot can be positioned in a wide space range of the machine side of the playing field using a unique design of ball catching and recycling net (MB).

14 Claims, 9 Drawing Sheets

DIGITALLY CONTROLLED, USER PROGRAMMABLE AND FIELD RELOCATABLE TABLE TENNIS ROBOT

TECHNICAL FIELD

Figure 1:
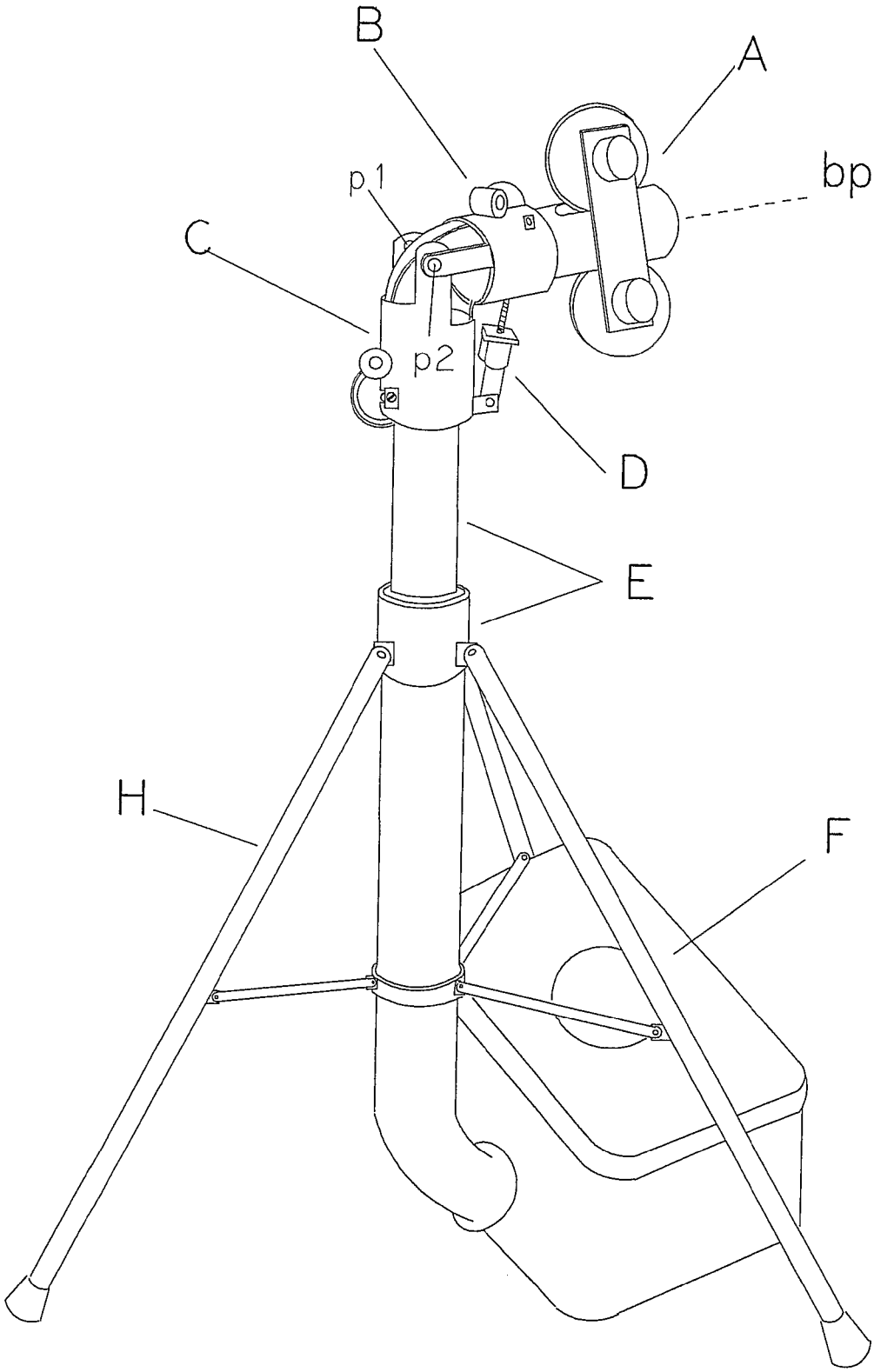

The present invention relates to an advanced table tennis robot that is technologically and functionally superior than any existing table tennis robots that are patented or on the market

BACKGROUND ART

For decades, types of table tennis robots have been invented, patented, and manufactured These devices sequentially project table tennis balls from the machine side of the playing table (or playing court) to the top of the table on the players side at various time intervals and trajectories with different ball flying speeds and ball spinning rates for the player to practice As some examples, attention is directed to the following patents (U.S. Pat. Nos. 3,794,011, 4,116,438, 4,325,351, 4,917,380, 4,844,458, 5,009,421, 5,335,9054, 5,383,658, 5,485,995, 5,533,722, 6,186,132, 6,202,236, 6,371,872, 6,604,517, Chinese Patents Nos. 02217946, 03218645, 87214545, 93213663, 93244555, 94217832, 97240522, 98230401, 99207740)

TECHNICAL PROBLEM

The aims of table tennis robots are to simulate human table tennis players and to project table tennis balls from the machine side of the play field to the top of the other side of table, with the ball flying speeds, trajectories and spins an opposing human player may produce in actual table tennis games, for the human players to practice None of the existing patented technologies has achieved this satisfactorily First, Programmability In table tennis games, each of the balls returned by the opposing player has its unique flying speed, trajectory and spin The ideal table tennis robot should allow the user to program the parameters (in other words, the characteristics) of the served ball such as the flying speed, initial 3 dimensional ball projecting orientation (ball projecting line), trajectory and spin, to any values within ranges a human opposing player can produce with high enough digital resolutions (for example, 8 bit or 16 bit) and store a sizable number of those parameter sets in the system memory as (table tennis) shot libraries and have the robot to recall any set of those parameters and reproduce the shot defined by the parameters when needed, thus one can program and store the kind of shots and the sequence of the shots he/she want to practice returning and have the robot to serve (repeat, if desired) the shots and shot sequences anytime push button automatic None of the existing patented technologies has this capability Most of them need to manually adjust something mechanical to change one or more of the parameters of a shot U.S. Pat. No. 6,186,132 does have motor driven ball positioning mechanisms and uses microcontroller to control them but those are only simple logical controls since the position information of those mechanisms are not digitized Second, being Field Relocatable In table tennis games, the opposing players may return a ball from any point within the 3 dimensional space of his/her side of the playing court, sometimes from close to the end of the table, sometimes from over 5 meters away from the end of the table, sometimes from a height of his/her knee, sometimes from a height above his/her shoulder, and everywhere in between. None of the existing patented technologies equipped with ball catching and recycling nets can even cover a sizable fraction of this space. Some are mounted at a fixed point at the end of the table, some are stand alone at a small distance from the end of the table All of the existing design equipped with ball catching and recycling nets can only be deployed at a fixed location (relative to the table). Otherwise the ball catching net will not function satisfactorily This is because the ball catching and recycling net of these designs have only one deployed size, location and geometry U.S. Pat. No. 6,200,236 introduced a system that has very limited lateral (parallel to both the floor plane and the end of the table) range of relocating the ball projecting head of the robot but neither longitudinal (toward or away from the end of the table, along a line parallel to the floor plane and perpendicular to the end of the table) nor vertical (along a line perpendicular to the floor plane). U.S. Pat. No. 6,371,872 added limited vertical relocating capability of the ball projecting head but no longitudinal.

TECHNICAL SOLUTION

The descriptions and figures disclosed here are by way of examples and not by way of limitations. That's been said, here is the solution FIG. 1 is the current invention with the ball catching and recycling nets not shown (which will be described in other drawings) In FIG. 1, A is the ball projecting head and bp is the ball projecting line B is the sidespin angular position mechanism which rotates A around bp to set the angle of sidespins of the balls being projected D is the horizontal angular position mechanism of the robot which rotates A, B and C together around a fixed vertical axis B and D are connected with pins p1 and p2 C is the vertical angular position mechanism of the robot which is a motor driven lead screw assembly and which turns A and B together up and down around the axis formed by p1 and p2 to change the angle between line bp and the floor plane as needed E is a multi-sectional vertical shaft. F is a container which holds a number of table tennis balls, houses a motor driven ball feeding mechanism and the electronics of the system H is a tripod to support the whole system on the floor.

Figure 2:
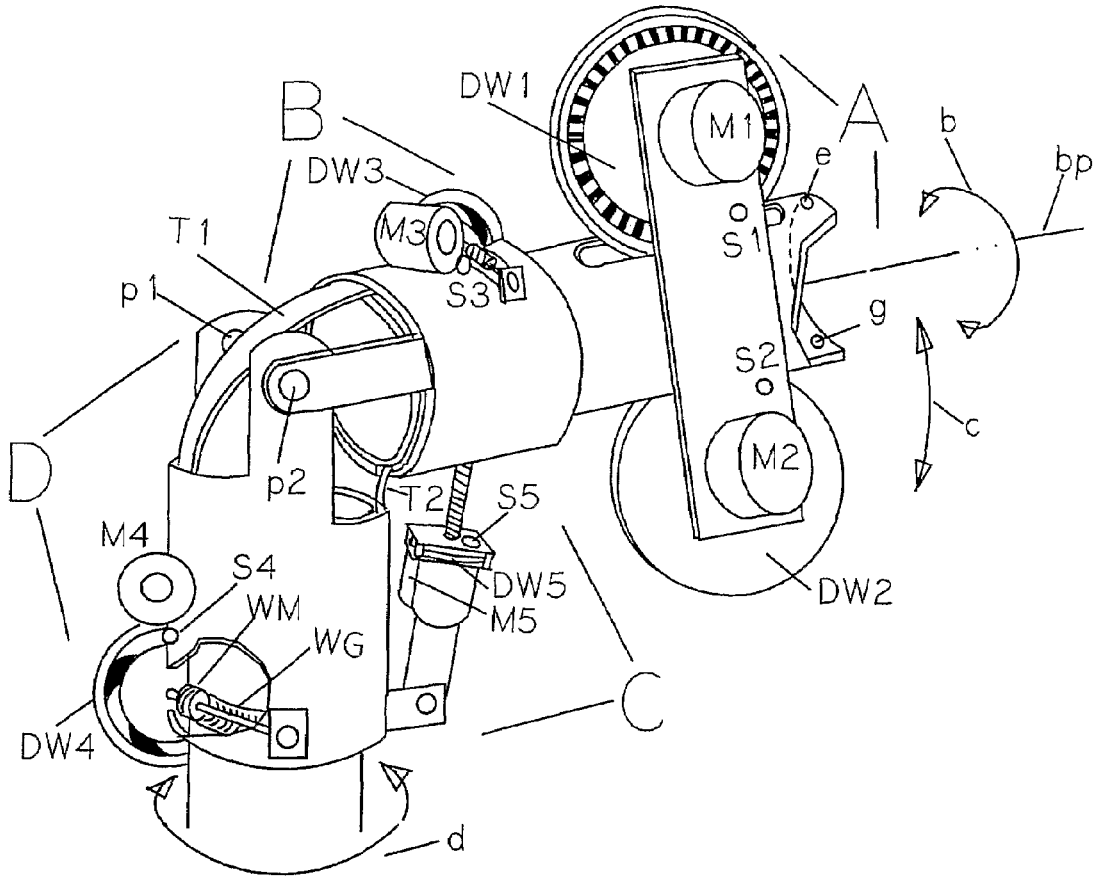

FIG. 2 shows the A-B-C-D parts of the system in detail As shown in FIG. 2, the ball projecting head A consists of two motors M1, M2 mounted across a section of pipe using a mounting plate, two table tennis ball driving wheels DW1 and DW2 mounted on the shafts of M1, M2, reflective infrared sensor S1, S2, infrared emitting diode e and infrared detector facing e across the pipe. The size of the pipe will allow table tennis balls to go through The distance between the rubber edges of DW1 and DW2 is a little smaller than the diameter of the table tennis ball When a table tennis ball is pushed through the pipe from left to right in FIG. 2, it's caught by the edges of DW1 and DW2 and thrown out with the speed, spin and orientation determined by the turning speeds and directions of DW1 and DW2, and the orientation of line bp. DW1 and DW2 are mounted around and across the longitudinal center line of the ball projecting pipe in such a way that this center line and line bp become the same line. DW1 and DW2 each has a ring band on it (only that of DW1 is shown in FIG. 2) and infrared light reflecting and absorbing bars are alternatively and evenly distributed along the band. When DW1 and DW2 turn, S1 and S2 facing those ring bands will send out strings of electric pulses to the digital controller of the system The rates of the pulses represent the turning speeds of DW1 and DW2 respectively The digital controller repeatedly compares the detected turning speeds of the wheels with their set points and adjust the voltages driving M1,M2 thus forming the closed loop digital speed controls of DW1 and DW2. The infrared reflective ring band on DW1 and the reflective infrared sensor S1 together function as an incremental optical encoder where the components of the encoder are embedded in different parts of the motion control mechanism As other embodiments of this invention, stand-alone encoders (not necessarily optical), incremental or absolute, can be used and mounted somewhere in the motion transmission linkages. Or motors with built in encoders (usually mounted on the back end shaft of the motor) can be used But these embodiments are structurally more complicated and will generally cost more When a table tennis ball is projected out, it blocks the infrared light emitted by e briefly, and g will detect this and send a pulse to the digital controller thus provides a means of verifying when and how many table tennis balls have been projected As shown in FIG. 2, the horizontal angular position mechanism of the robot D consists mainly of two sections of pipes, one (the inner pipe) inserted in the other (the outer pipe) WM is a mechanical worm assembly consists of a worm and the worm driving wheel DW4 (which can either be a gear for geared driving or a pulley for belt driving) mounted on a shaft The shaft of WM is mounted on the outer pipe of D using bearings and brackets at both ends of the WM shaft The matching worm gear WG is embedded in the body of the inner pipe of D The inner pipe of D and the inner pipe of E are actually different sections of the same vertical pipe DW4 is driven by electric motor M4 through either a driving belt or common gear linkage Proper rotary bearings (not shown in the figure) are installed between the inner pipe and the outer pipe at both ends of their overlapping section. When WM turns driven by M4, a rotary motion of the outer pipe of D will be produced around a vertical axis determined by the two rotary bearings as indicated by the double ended arrow d, carrying everything mounted on the outer pipe of D (i e WM, M4, S4, A, B and C) to rotate together. S4 is an infrared reflective sensor same as S1 and S2 and it detects the motion of DW4 the same way Only the boundaries of the infrared light reflecting and absorbing areas on DW4 are not straight lines like those on DW1 and DW2 but are curved lines. This is to prevent false pulses being triggered by mechanical vibrations The digital controller of the system keeps track of the pulses generated by S4 and the turning direction of the motor M4 thus keeps track of the position and speed of this mechanism and generates proper controls of M4 all the time This forms an axis of closed loop digital position control (while the speed can also be controlled as an intermediate parameter) of the system, using embedded encoder, realizing the lateral swing and positioning of the ball projecting head of the robot. As other embodiments of this invention, embedded common type gear can be used on the inner pipe instead of embedded worm gear and stand-alone encoder (not necessarily optical), incremental or absolute, can be used for encoding the motion of the mechanism Or a motor with built in encoders can be used Or a step motor can be used But these embodiments are generally bulkier, more complex and expensive Part B in FIG. 2, the sidespin angular position mechanism of the robot, is exactly the same design as part D. The brackets on the outer pipes of D and B are mechanically connected with pins p1 and p2 The inner pipe of B is connected with the pipe of the ball projecting head A When motor M3 turns, the inner pipe of B and the ball projecting head A will turn together around line bp (as indicated by the double ended arrow b) and set the angle of sidespin of the projected balls this way as needed This is another axis of digital closed loop position controls of the robot Part C in FIG. 2, the vertical angular position mechanism of the robot, is a motor driven lead screw assembly One end of the assembly is fixed on the outer pipe of D with bracket and pin The other end of the assembly is fixed on the outer pipe of B with a pin When motor M5 turns, the distance between the two ends of the assembly changes thus rotating A and B together around the horizontal axis formed by pins p1 and p2, as illustrated by the double ended arrow c. This vertical rotation of A and B realizes different heights of trajectories of the projected balls (i e the elevation control). T1 and T2 in FIG. 2 are tongue shaped components made of semi-rigid elastic materials. They help to maintain a smoothly curved ball passage between D and B all the time when B-A assembly swings up and down.

Figure 3:
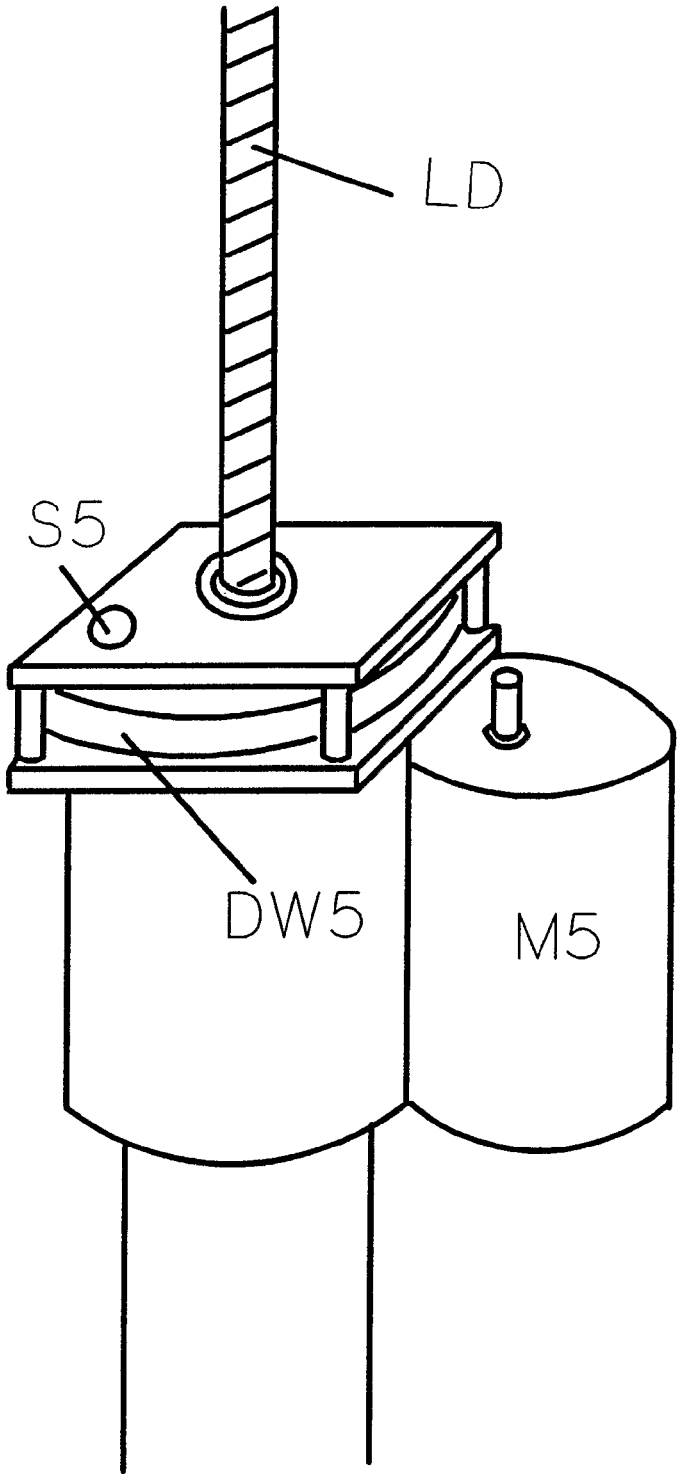
Figure 4:
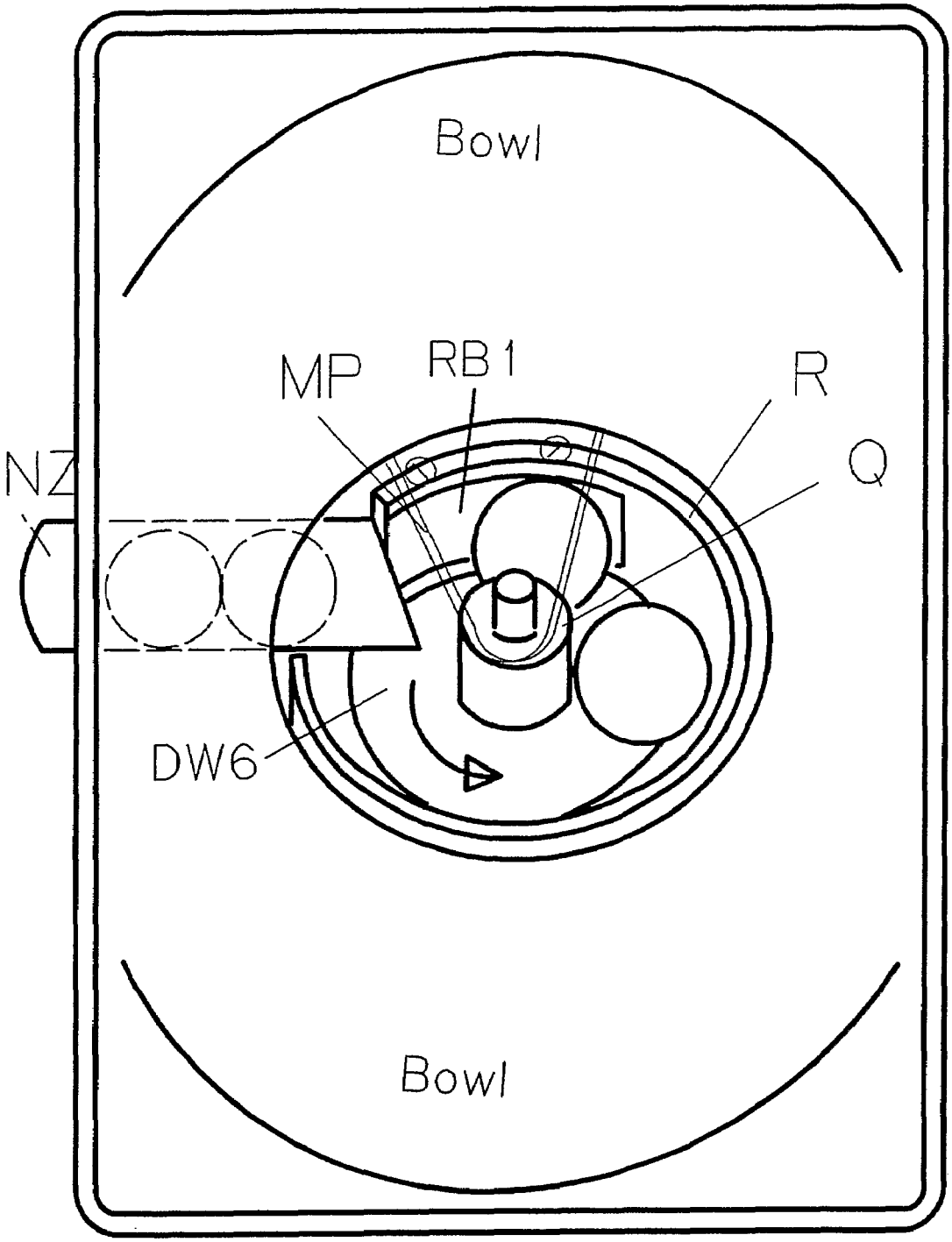

FIG. 3 shows some more details of part C LD is the lead screw rod, DW5 is a driving wheel with its center hole threaded matching the threads of LD. DW5 can be either a pulley for belt driving or a gear for gear driving embodiments The housing of the lead screw is a pipe shaped structure On top of this pipe, two mounting plates with center holes are mounted There is a vertical distance between the two plates and this is created by using spacers between the plates as shown in FIG. 3 DW5 is installed between the plates and LD go through the center hole of DW5 and the center holes of the two square plates. There is also an infrared reflective ring band similar to that on DW4 on the top surface of DW5 When M5 drives DW5 to turn, infrared reflective sensor S5 facing the ring band on DW5 will detect the movements of DW5 and send signals to the digital controller, enabling the digital controller to track and digitally control the position of LD by driving M5 accordingly. Thus one more axis of digital closed loop position controls of the robot The mechanical linkage between the shaft of M5 and DW5 is not shown in the figures It can be either belt driving or gear driving linkage FIG. 4 shows a birds view of some inside details of part F in FIG. 1 As shown, the lower part of the inside of the container has a bowl shaped surface This shape allows all the balls contained in the box to roll easily down to the bottom round opening of the bowl and fall further down into the ball feeding mechanism located directly under this opening) just by the action of the earth's gravity The ball feeding mechanism consists of an outer cylinder R which is fixed on the bottom of the box, an inner cylinder Q, a nozzle pipe NZ fixed on the bottom of the box with one end of the nozzle sticking into the space between the inner and outer cylinders through the opening of the outer cylinder and the other end extended out of the container, a motor driven wheel DW6 and a mounting plate MP The inner cylinder Q is fixed on top of DW6 The top end of the Q-DW6 assembly is held in place with a rotary bearing by MP and MP is screw fixed on the top edge of R The bottom end of the Q-DW6 assembly is held in place with a rotary bearing embedded in the bottom of the container R and the Q-DW6 assembly share the same vertical center line which is also the rotating axis of Q-DW6 assembly DW6 can be either a gear if geared drive is used or a pulley if belt drive is used The vertical outside surface of Q and a section of the inside surface of R. RB1, are made of rubber The distance between the rubber surfaces is a little smaller than the diameter of the ball and the distance between the vertical outside surface of Q and the non rubber covered inside surface of R is a little bigger than the diameter of a table tennis ball. When Q-DW6 assembly turns in the direction shown by the arrow in FIG. 4, balls fallen on top of DW6 will be moved around and eventually get caught between the two rubber surfaces and pushed into the nozzle NZ The nozzle is connected to the bottom elbow of part E in FIG. 1, enabling the balls to be pushed one next to another all the way up to the ball projecting head A. The advantage of the two cylinder ball feeding mechanism is that it moves the balls at a very steady speed thus the timing of projecting the balls can be precisely controlled and the balls rolling between the two rubber surfaces forms another stage of speed reduction and force amplification As described earlier, e and g pair in FIG. 2 will detect when and how many of the balls have been projected and the digital controller uses this information to turn on or off the motor (not shown in the figure) driving DW6 accordingly. The left over spaces inside box F and under the ball holding bowl are used to house the digital control electronics of the system and the motor driving DW6

Figure 5:
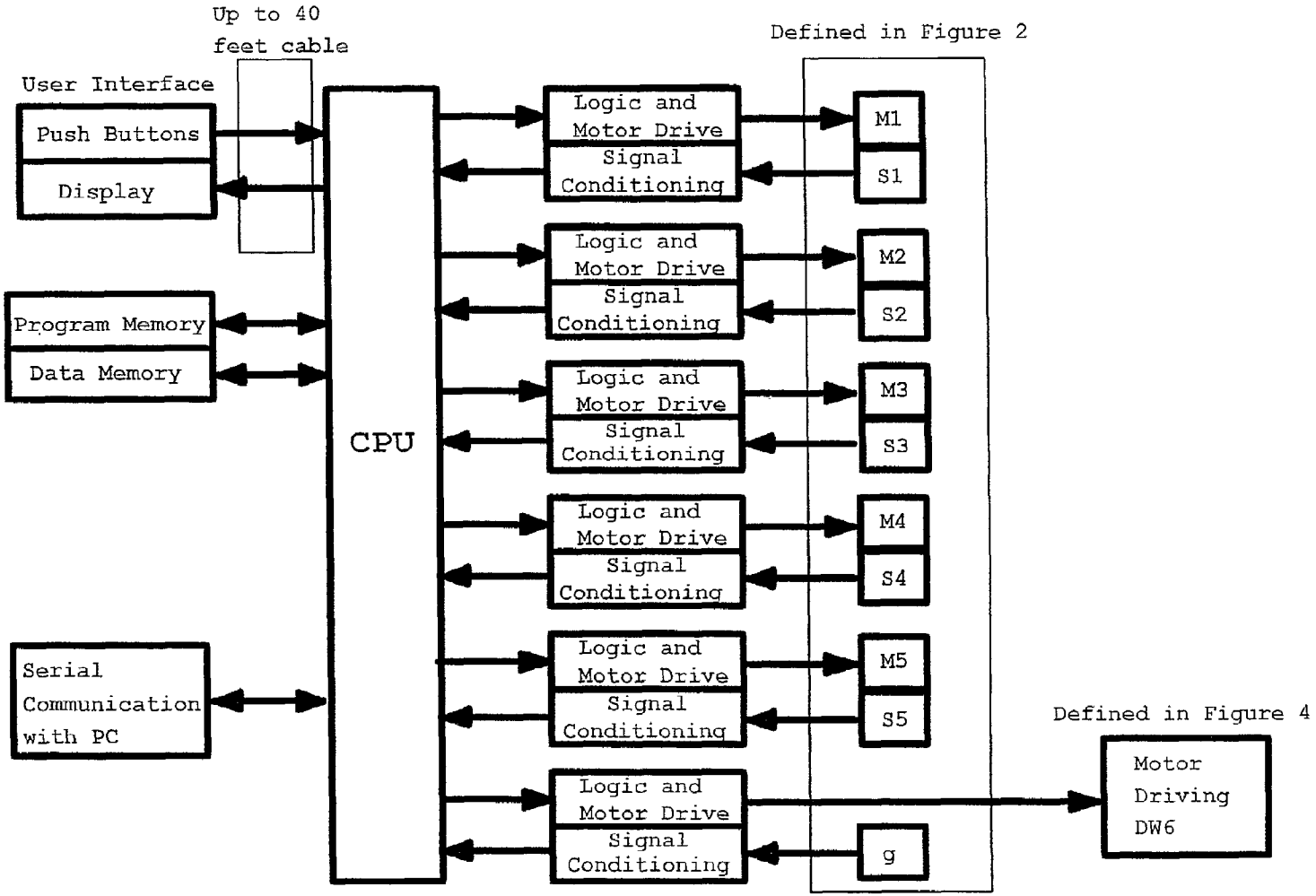
Figure 6:
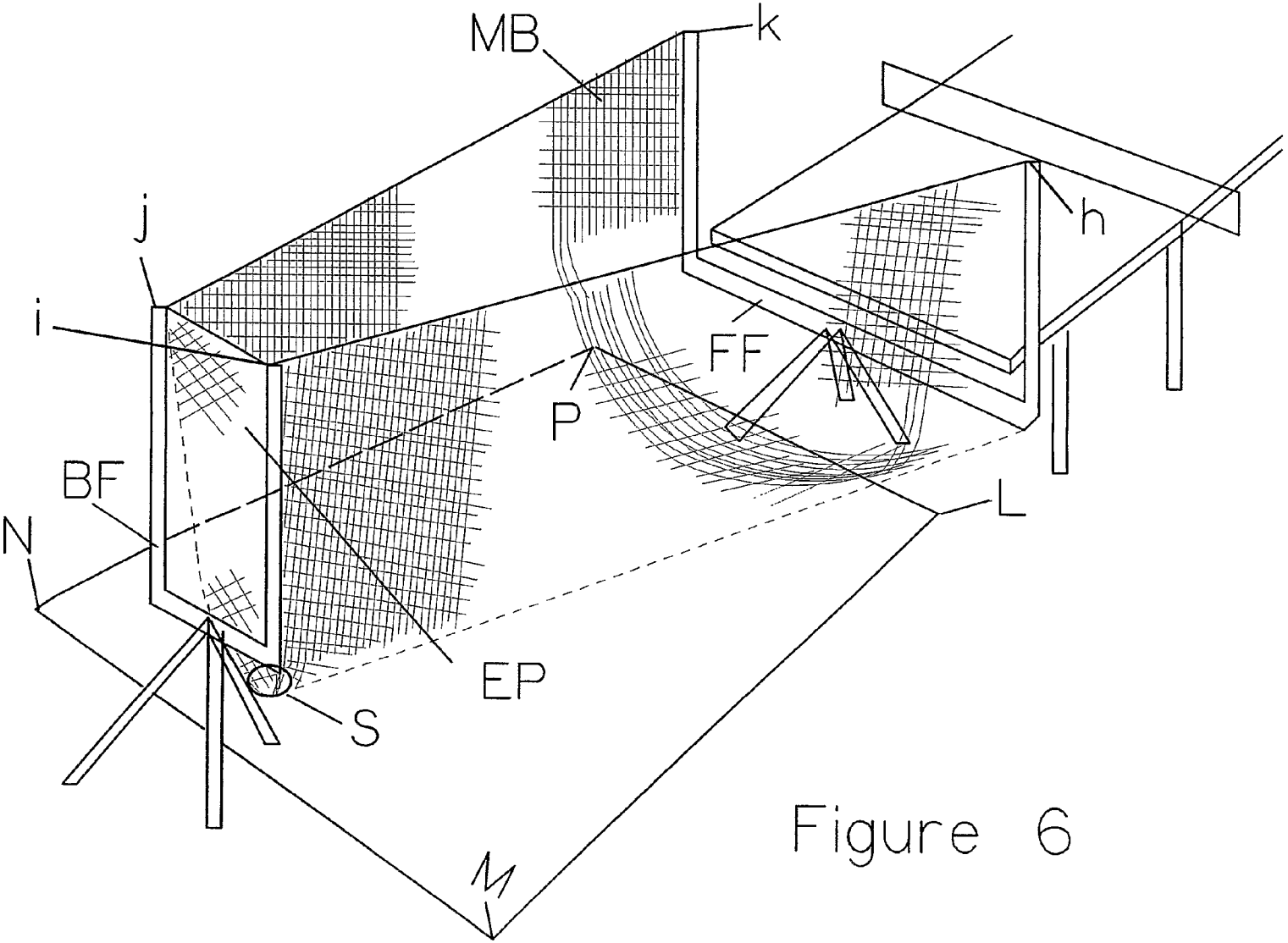
Figure 7:
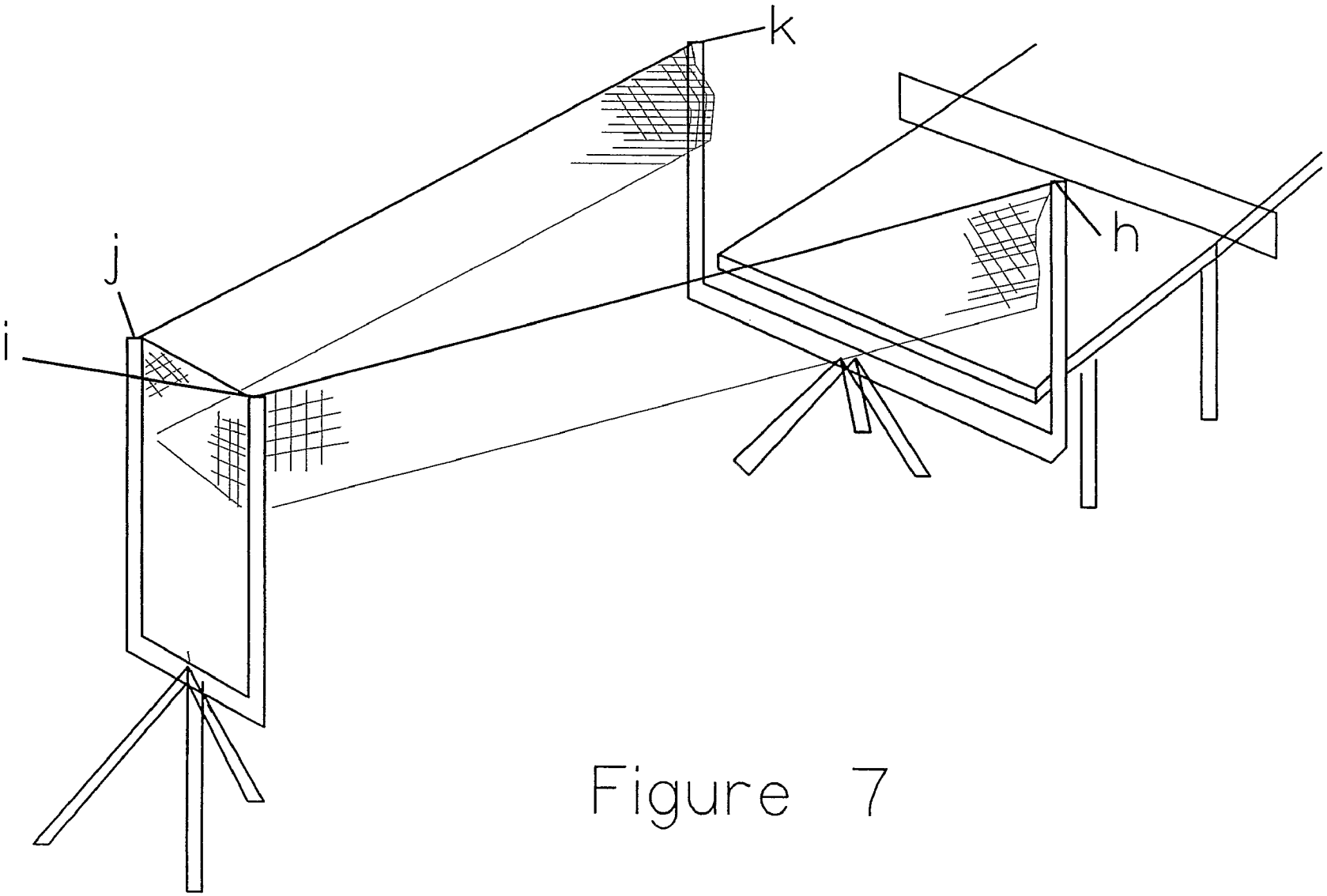
Figure 8:
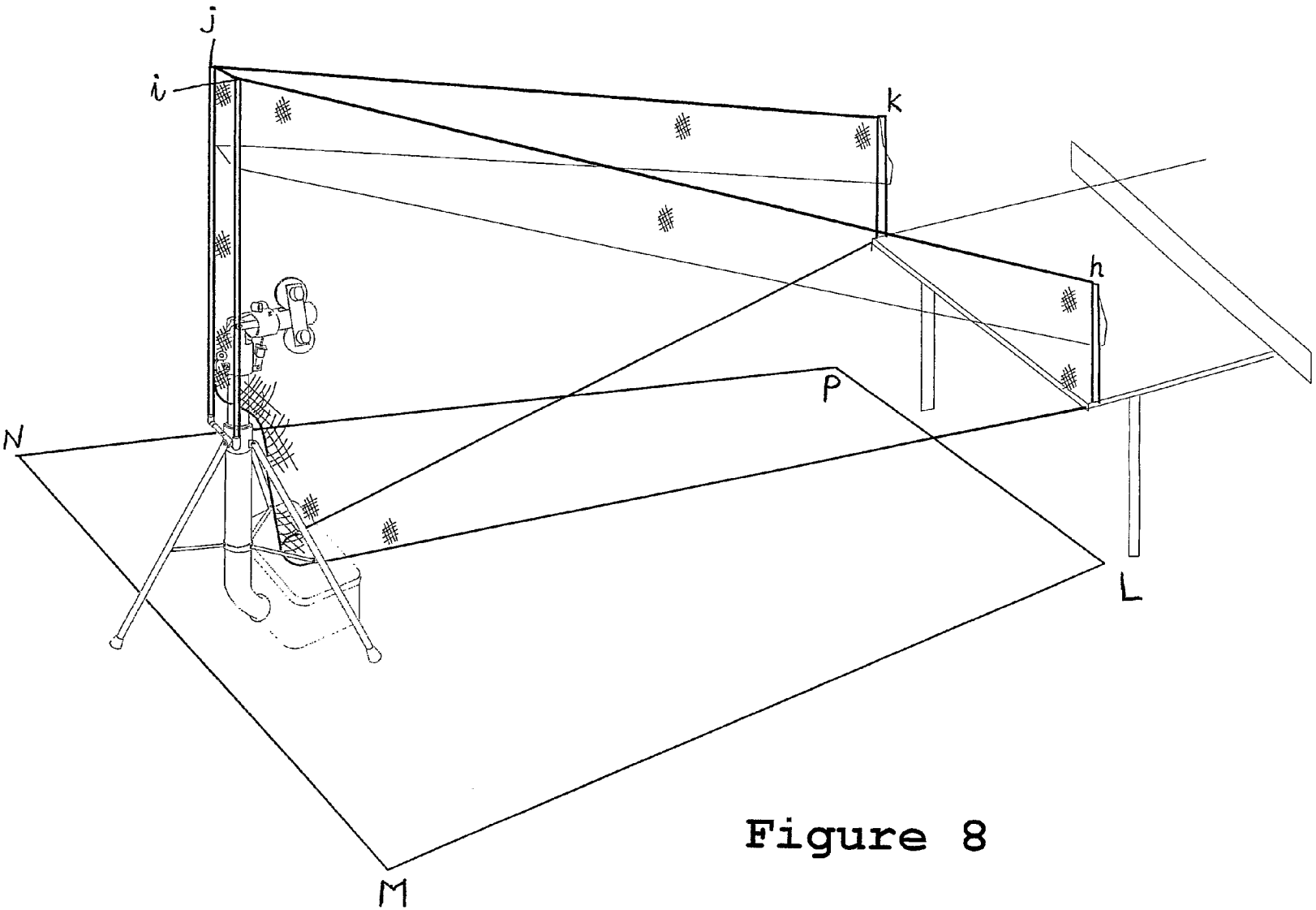
Figure 9:
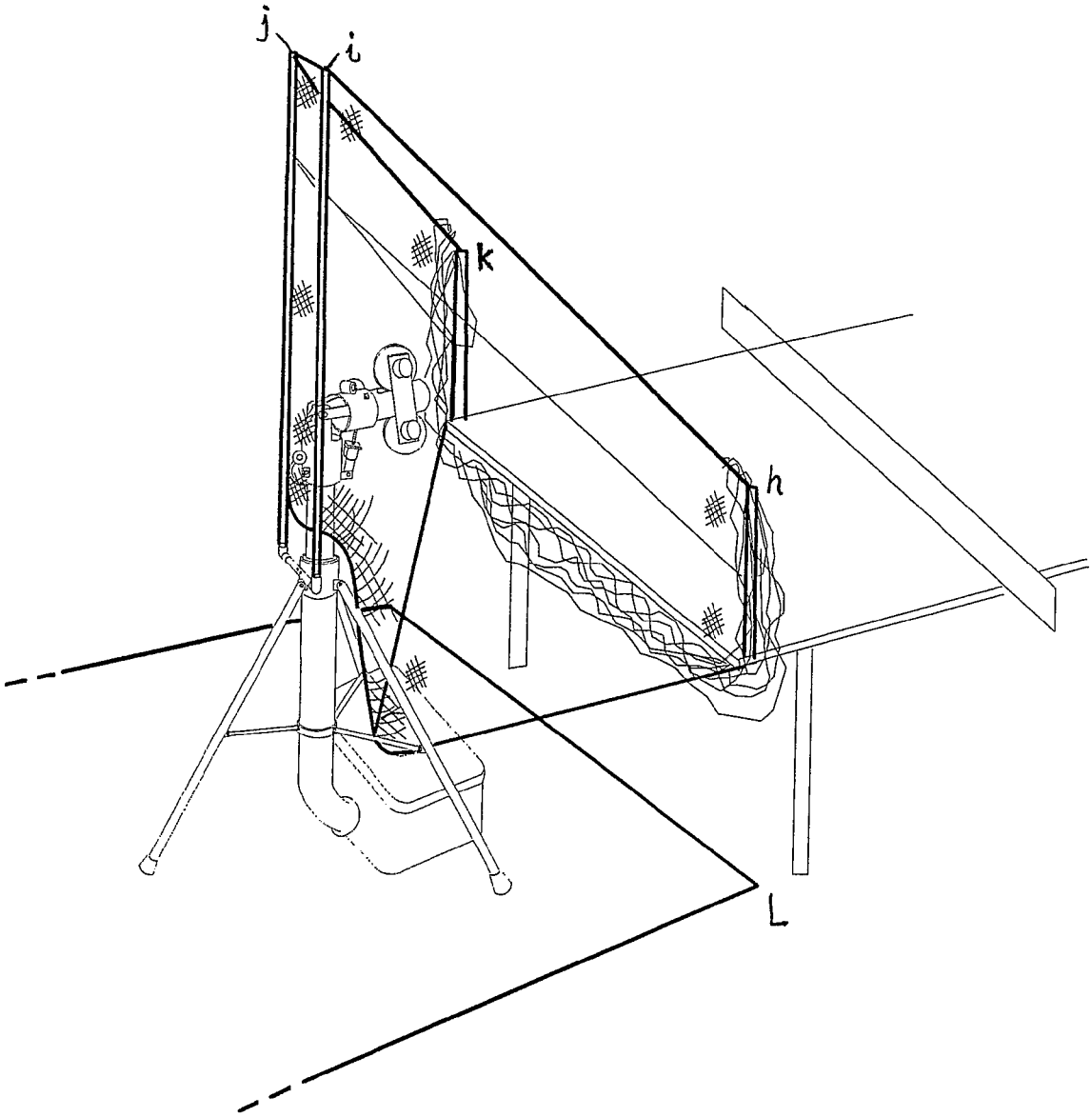

In summary of the above, the current invention deploys five electric motor driven motion control mechanisms Two speed controls in part A for producing desired flying speeds and spins of the projected balls, one position control each in parts B, C and D for positioning (i e aiming) the ball projecting head to produce desired trajectories, points of impact on the table and sidespins, of the projected balls. Each of the motion controls is equipped with an encoder, optical or other, incremental or absolute, embedded (defined as having one or more major elements embedded in a component of the motion control mechanism which has other functions in addition to encoding) or stand alone (having its own housing), with using embedded encoders depicted here being the best mode embodiment. These encoders provide digitized feedbacks for the motion control mechanisms and using a digital controller (a microcontroller, microprocessor DSP or even personal computer) combined with proper electronics (logic and motor drives, signal conditioning for sensors, user interface), fully digital control of the robot is realized. Each set of the controlled parameters of these five motion control mechanism form a vector defining a unique ball placement (i e a shot) Predefined vectors can be generated and stored in the system memory as libraries and recalled to produce the desired shots in a fraction of a millisecond when needed. With proper programming, the user will be able to generate new libraries and edit existing libraries, the calls to different vectors in the libraries can also be sequenced with proper timing to produce combinations of shots for the training player to practice and combination libraries can also be generated Thus complete user programmability of the robot is realized FIG. 5 is the function block diagram of the electronic subsystem of the robot Since there are tens of thousands different types of CPUs (microcontrollers, microprocessors or DSPs) on the market which can be suitable for this invention and there are even more ways to implement each function block in FIG. 5 electronically and to program the system. No more details are presented here Part E in FIG. 1 is a multi-sectional pipe structure (only two sections are shown in the figure) used to hold the upper part of the robot at proper heights from the floor All sections of pipes of E share the same longitudinal center line and the inner pipes can be extended out of the outer pipes or retracted into the outer pipes thus change the overall height of the robot Proper slide bearings are used between sections to make the sliding in and out operations smooth and propel set screws are used to secure the positions when needed. Part E also provide a passage for balls to be pushed through from the outlet of part F all the way to part A FIG. 6 shows the ball catching and recycling net of this invention The net consists of a main body, MB, which is roughly but not necessarily rectangular when laid flat down, an end piece, EP, of proper net material used to close one end of the net, and one or more supporting flames to support and suspend the net in its deployed shapes and positions The deployed shapes and positions of the net are such that the front open end of the net surrounds the end of the table tennis table, the roughly vertical inside surfaces of the net are high enough to catch all the balls returned by the practicing player and bouncing off the machine side of the table, the inside lower surface of the net is smoothly curved and sloped enabling the balls entering the net to always roll to a fixed spot on the bottom of the net, just by the action of the earth's gravity The balls accumulated at this spot can then be transported into the ball feeding mechanism of the robot By using the elasticity of the net material and/or by different ways of hanging the net on the frame(s) and/or by changing the shapes and locations of the frame(s), the net can have many deployed sizes, shapes and positions As one embodiment of this invention, two stand-alone supporting frames are used in FIG. 6 The front frame FF and the back frame BF The upper part of the flat U shaped FF surrounds the end of the table completely The back frame BF has a narrow and tall U shaped upper part. When using this frame configuration, the changing of the deployed sizes and shapes of the net does not depend on the elasticity of the net material, as a matter of fact, too much elasticity of the net material might have negative effects The narrower BF allow the top of the net at the back end to go higher (which is ideal since within certain distance from the end of the table, the balls bouncing off the table are in the rising curve) and the bottom to go lower (which is also ideal since the bottom surface of the net will be a smooth down slope from the front to the back of the net and all the balls entering the net will roll to one single spot marked by the circle S in FIG. 6) The distance between BF and FF (i.e. the effective length of the deployed net) can be as far as the full length of the main body of the net, or BF can be put right next to FF. When this distance is smaller than the full length of the main body of the net, the excessive net material can be rolled up along the flat U of the FF or just pushed together aside and under the flat U of FF. BF can be located at any spot within the L-M-N-P area on the floor shown in FIG. 6 and the net still functions satisfactorily Depending on the properties of the net material and the frames, a string or rigid beam may be used from h to i and from j to k, when needed A band of net material with the width of about 30 to 60 cm can be added hanging along the top edges of the net when needed, overlapping the upper inside part of the main body of the net, as shown in FIG. 7 (the main body of the net is not shown in FIG. 7) This helps to prevent balls with top spins from escaping the net After hitting the vertical wall of the net, balls with top spins tend to climb up the wall and the overlapping band shown in FIG. 7 traps them and allow them to fall back to the bottom of the net FIG. 8 shows another embodiment of the design of the net which is also the best mode of the net. In FIG. 8, the table tennis table, the robot of the current invention and the ball catching and recycling, net of the current invention are integrated into one system The two detachable posts clamped on and combined with the end of the table form the front frame of the net and the back frame is mounted on the robot Two fiber glass composite multi-section retractable and extendable beams similar to Chinese style fishing poles (not shown in the figure) are used in the sleeves along the top edges of the net h-i and j-k to better support the net. The robot can be located anywhere within the L-M-N-P marked area with perfect ball catching and recycling The distance between L and M can be up to 7 meters and up to 5 meters between M and N using common nylon net fabrics. FIG. 9 illustrate another deployed geometry of the net when the robot is placed close to the end of the table FIG. 9 also shows how the excessive net material are pushed together and hung aside and under the front frame of the net when the distance between the front frame and the back frame is smaller than the fill length of the net The feature of part E of the robot in FIG. 1 combined with the ball catching and recycling net of the present invention makes the ball projecting head relocatable anywhere within a wide three dimensional space on the machine side of the playing field.

The invention claimed is:

1. A digitally controlled fully automatic and user programmable table tennis robot comprised of a ball holding container and an electric motor driven ball feeding mechanism disposed at the bottom of the robot, a vertical multi sectional extendable and retractable shaft with its bottom end connected to the outlet of said ball feeding mechanism and top end connected to one of the upper parts of the robot, supporting said upper parts of the robot and providing a vertical passageway for table tennis balls from said ball feeding mechanism to said upper parts of the robot; a ball projecting head comprised of two directly motor driven speed controlled ball projecting wheels mounted around and across a ball passage pipe, an electric motor driven horizontal angular position mechanism, an electric motor driven vertical angular position mechanism, an electric motor driven sidespin angular position mechanism, a tripod attached to said multi sectional vertical shaft to support the robot on the floor, a digital controller comprised of a CPU and proper power electronics, sensor electronics, logic, memory, user interface and programming.

2. A table tennis robot as defined in claim 1 wherein said ball projecting wheels can turn in both directions (clockwise and counterclockwise) and each of the speed control mechanisms for said ball projecting wheels is equipped with an encoder to provide the digital controller of the robot with motion feedback and the speeds of said mechanisms are digitally controlled.

3. A table tennis robot as defined in claim 1 wherein said horizontal angular position mechanism is comprised mainly of two relative rotating members, an outer member and an inner member with said inner member having adequate size to allow table tennis balls to pass through, wherein said two members are assembled together in such a way that they can rotate relative to each other but little or no longitudinal relative movement is allowed and an electric motor and speed reduction stages are included to drive the relative rotation.

4. A horizontal angular position mechanism as defined in claim 3 wherein one of the speed reduction stages is a worm-worm gear speed reduction and said mechanism is further equipped with an encoder to provide the digital controller of the robot with digitized position feedback and the motion of said mechanism is digitally controlled.

5. A table tennis robot as defined in claim 1 wherein said sidespin angular position mechanism is comprised mainly of two relative rotating members, an outer member and an inner member with said inner member having adequate size to allow table tennis balls to pass through, wherein said two members are assembled together in such a way that they can rotate relative to each other but little or no longitudinal relative movement is allowed and an electric motor and speed reduction stages are included to drive the relative rotation.

6. A sidespin angular position mechanism as defined in claim 5 wherein one of the speed reduction stages is a worm-worm gear speed reduction and said mechanism is further equipped with an encoder to provide the digital controller of the robot with digitized position feedback and the motion of said mechanism is digitally controlled.

7. A table tennis robot as defined in claim 1 wherein said vertical angular position mechanism is a lead screw assembly comprised of a lead screw rod, a pipe shaped housing into or out of which the lead screw rod can be retracted or extended, a lead screw driving wheel with its center hole having the matching thread for the lead screw rod, an electric motor with proper pulley or gear on its shaft and two mounting plates with center holes mounted on top of said housing and separated with spacers and the lead screw driving wheel is rotationally sandwiched in between said mounting plates with the center holes of the lead screw driving wheel and said mounting plates aligned and through which the lead screw rod is installed.

8. A table tennis robot as defined in claim 1 wherein said vertical angular position mechanism is further equipped with an encoder to provide the digital controller of the robot with digitized position feedback and the linear motion of the lead screw rod in said mechanism is digitally controlled.

9. A table tennis robot as defined in claim 1 wherein said ball container and ball feeding mechanism is comprised mainly of a down sloped bowl like lower surface enabling table tennis balls to always roll down to the bottom opening of the container when there is room with said ball feeding mechanism being disposed directly under said bottom opening and with said ball feeding mechanism being mainly comprised of an outer stationary cylinder, an inner rotating cylinder, a driving wheel connected with the bottom of said inner rotating cylinder, a nozzle pipe, and a motor to drive the inner rotating cylinder and the driving wheel assembly, wherein near the entrance of said nozzle pipe, the distance between the inside surface of said outer cylinder and the outside surface of said inner cylinder is a little smaller than the diameter of the table tennis ball and when said driving wheel is driven by said motor to turn counterclockwise, table tennis balls fallen in the chamber, of said mechanism will be pushed around and eventually into said nozzle pipe.

10. A table tennis robot as defined in claim 1 wherein said vertical multi sectional extendable and retractable shaft is comprised of multiple sections of pipes of similar length but different diameters and said smaller pipes are inserted into the next bigger pipes with configurable length of overlapping such that the overall height of the shaft is configurable in a wide range.

11. A table tennis robot as defined in claim 1 wherein said robot is equipped with predefined and user generated, user editable, digital libraries with the elements of the libraries defining different table tennis shots and shot sequences and said elements can be recalled by the digital controller of the robot to reproduce those shots and shot sequences at the users disposal.

12. A table tennis ball catching and recycling net comprising a front frame which surrounds the front end of the table and is shaped as a wide, flat letter U, a back frame shaped as a tall, narrow letter U; a rectangular shaped main body of the net made of flexible materials with the width of the main body being equal to the combined length of the three sides of the flat U shaped front frame and the main body being supported by the upper tips of said front frame and back frame and supporting strings connecting the upper tips of the front frame and the back frame; the distance from the front frame to the back frame being freely configurable from less than 20 cm to the full length of the main body and the lower inner surface of the main body always forming a continuous down slope from the front frame end to the back frame end with the excessive length part of the main body (when the distance from the front frame to the back frame is smaller than the full length of the main body) being pushed under and around the front frame;

an end piece of material similar to the main body used to seal the back end of the main body.

13. A table tennis ball catching and recycling net as defined in claim 12 wherein the net is equipped with a 30 cm to 60 cm wide and suitable length of net material hanging at proper height, around and mainly horizontally along the inside upper surfaces of said main body of the net.

14. A digitally controlled, user programmable and field relocatable table tennis robot system comprising the table tennis robot as defined in claim 1 and the ball catching and recycling net as defined in claim 12 wherein the front frame of said net is embodied as two rigid posts clamped on the end of the machine side of the table forming a flat and wide U shaped front frame of the net together with the front end of the table, and the back frame of the net is embodied as a narrow and tall U shaped rigid frame mounted on the vertical shaft of the robot.

* * * * *